US005103999A

United States Patent [19]

Elliott et al.

[11] Patent Number: 5,103,999

[45] Date of Patent: Apr. 14, 1992

[54] FOLDING PAINT TRAY

[76] Inventors: Raymond Elliott, 8 Alonna Street, Bowmanville, Ontario, Canada, L1C 3P6; Kevin O'Brien, 799 Rodney Court, Oshawa, Ontario, Canada, L1G 6V6

[21] Appl. No.: 724,153

[22] Filed: Jul. 1, 1991

[30] Foreign Application Priority Data

Feb. 1, 1991 [CA] Canada ..... 2035553

[51] Int. Cl.[5] ..... B65D 5/22; B65D 85/00

[52] U.S. Cl. ..... 220/570; 206/45.18; 229/171

[58] Field of Search ..... 229/103, 171, 174, 176; 206/45.18, 45.19, 45.25; 220/570

[56] References Cited

U.S. PATENT DOCUMENTS

| | | | |
|---|---|---|---|
| D. 254,482 | 3/1980 | Bell | D9/290 |
| 1,592,922 | 7/1926 | Burnham | 206/45.18 |
| 2,550,968 | 5/1951 | Bussey | 206/45.18 |
| 2,659,917 | 11/1953 | Drum | 220/570 |
| 2,887,705 | 5/1959 | Serwer | 220/570 |
| 2,988,260 | 6/1961 | Locke et al. | 220/570 |
| 3,395,828 | 8/1968 | Schnabel | 220/90 |
| 3,688,943 | 9/1972 | Brown | 220/90 |
| 3,858,787 | 1/1975 | Bamburg et al. | 229/171 |
| 3,945,527 | 3/1976 | Pylant | 220/90 |
| 3,947,135 | 3/1976 | Hawk | 401/121 |
| 3,980,213 | 9/1976 | Ramsay | 222/485 |
| 4,150,763 | 4/1979 | Simpson | 220/90 |
| 4,225,064 | 9/1980 | Westcott | 222/569 |
| 4,813,594 | 3/1989 | Brown et al. | 229/103 |

FOREIGN PATENT DOCUMENTS

| | | | |
|---|---|---|---|
| 1085347 | 9/1980 | Canada . | |
| 1216258 | 1/1987 | Canada . | |
| 2502587 | 10/1982 | France | 229/171 |

*Primary Examiner*—Gary E. Elkins
*Attorney, Agent, or Firm*—Nixon & Vanderhye

[57] ABSTRACT

A rectangular paint tray is disclosed for painting with a roller, comprising a cut-out having flaps separated by folding lines which may be folded up to provide a disposable paint tray.

2 Claims, 5 Drawing Sheets

FOLDING PAINT TRAY

FIELD OF INVENTION

This invention relates to the field of painting and apparatus for painting, and in particular, relates to a foldable paint tray for use with a roller applicator.

PRIOR ART

It is common in the prior art to use a rectangular tray having an inclined surface to contain paint and to provide a surface for wetting a paint roller applicator. This basic kind of paint tray has remained virtually unchanged for many years, although certain improvements have been added to it to obtain a variety of corollary objects. An example of a rectangular type of paint tray is found in U.S. Pat. No. 3,947,135 entitled "Paint Tray", which issued to Gary D. Hawk, Mar. 30, 1976.

Other approaches to the problem of handling paint have included various devices attached to or floating within a paint can which permit a painter to dip the roller directly into the paint can and to remove excess paint from the roller. Examples of such devices are found in Canadian patent 1,216,258 entitled "Device for Scraping Off Liquid" which issued Jan. 6, 1987 to L. Rolin; U.S. Pat. No. 4,150,763 entitled "Paint Brush Scraper" which issued Apr. 24, 1979 to C.L. Simpson; Canadian patent 1,085,347 entitled "Gutter Apparatus for Collecting Spills from Paint Can" which issued Sept. 9, 1980 to M.E. Martin; U.S. Pat. No. 3,945,527 entitled "Paint Brush Wiping Device" which issued Mar. 23, 1976 to A.A. Pylant; U.S. design patent 254,482 entitled "Pouring Attachment for Paint Cans" which issued Mar. 18, 1980 to C.J. Bell; U.S. Pat. No. 4,225,064 entitled "Painter's Accessory" which issued Sept. 30, 1980 to R. Westcott; U.S. Pat. No. 3,395,828 entitled "Paint Can Attachment Device" which issued to F.C. Schnabel on Aug. 6, 1968; U.S. Pat. No. 3,688,943 entitled "Rim Protector and Painting Implement Container for Paint Cans" which issued Sept. 5, 1972 to D.C. Brown; and U.S. Pat. No. 3,980,213 entitled "Covers for Paint Cans" which issued Sept. 14, 1976 to R.A. Ramsay.

The disadvantage of previous paint trays is that they require cleaning and storage. People who are not in the business of painting, may be required to store the paint tray for years before it is needed again. The present invention is intended to provide a disposable, low cost paint tray which may be used once and then discarded.

GENERAL DESCRIPTION OF THE INVENTION

The present invention comprises a foldable, flat, cut-out to be folded along folding lines to fabricate a rectangular paint tray having a inclined surface.

In this application, the word "cut-out" is used to describe a flat sheet which has been cut with a die or other means into a desired shape. In the present invention, the cut-out may be made of cardboard or other suitable paper products, plastic or corrugated plastic sheeting or such further and other materials as would be obviously suitable for such construction.

In this specification the words north, east, south and west are used to indicate directions on the cut-out, in a relative sense, for the purpose of explanation. The words are not intended in an absolute sense.

The present invention is a cut-out to be folded into a paint tray comprising:

a rectangular base having an east and a west long side and a north and a south short side and four corners, said base being bounded by folding lines, an east and a west rectangular inner side flap, each having east and west long sides and north and south short sides, the east long side of the west inner side flap being attached along a folding line to the west long side of the base, the west long side of the east inner side flap being attached along a folding line to the east long side of the base, said inner side flap being otherwise bounded by folding lines, an east and a west rectangular outer side flap, each having east and west long sides and north and south short sides, the east long side of the west outer side flap being attached along a folding line to the west long side of the inner side flap, the west long side of the east outer side flap being attached along a folding line to the east long side of the inner side flap and being otherwise bounded by two folding lines and a side edge of the cut-out, four squares having four sides, each of said four squares being attached to a different one of the short sides of the inner side flaps along a folding line and each of said four squares being bisected by a folding line proceeding from the intersection of the folding lines at the corner of the base adjacent to the square to a diagonally opposite corner of the square, four triangular flaps, each having one side attached along a folding line to a different one of the short sides of the outer side flaps and having another side attached along a folding line to a side of an adjacent square, a rectangular first south flap bounded by folding lines and having a long side attached to the south short side of the base and having short sides attached on the east and west to an adjacent side of a square, a second south flap shaped as a trapezoid having a long side attached to the first south flap by a folding line and otherwise bounded by east and west cut-out edges which slant inwardly and a folding line, a rectangular tuck flap having a long side attached to the second south flap by a folding line and otherwise bounded by three cut-out edges, a rectangular first north flap having a long side attached along a folding line to the north short side of the base and having east and west short sides each of which is attached along a folding line to one of the squares next adjacent, a rectangular second north flap having a long side attached along a folding line to the first north flap and having east and west short sides being cut-out edges, a rectangular third north flap having a long side attached by a folding line to the second north flap and having east and west short sides being cut-out edges, a rectangular incline flap bounded by folding lines having a short side attached along a folding line to the third north flap said folding line having perforations spaced along its length;

two incline side flaps of triangular shape each having a long side attached along a folding line to a different one of the east and west sides of the incline flap; and a rectangular incline support flap having a long side attached along a folding line to the end of the incline flap and having three other sides being cut-out edges.

By folding the various flaps upon themselves in the manner described hereinafter, the cut-out may be shaped into a rectangular paint tray.

DESCRIPTION OF THE FIGURES

In the figures which illustrate the preferred embodiment of this invention.

DESCRIPTION OF PREFERRED EMBODIMENT

In the Figures, like numerals indicate like elements. The directions of north, east, south and west as used in this description may be taken from FIG. 2 in which north is at the top of the page, or, to the right when reading the lettering on the figure.

Figure 2:
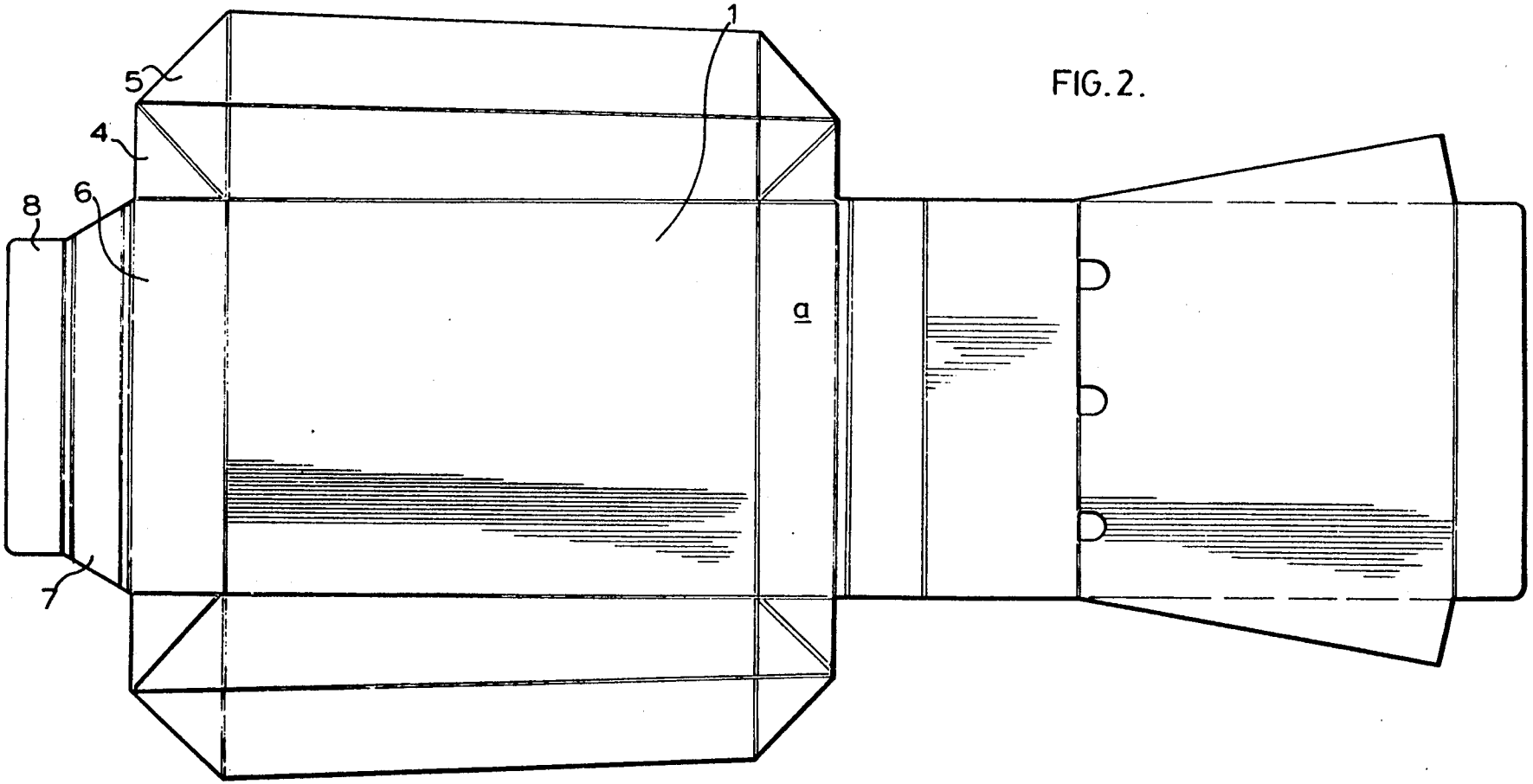
FIG. 2 illustrates the cut-out from which the paint tray of this invention is formed.

Referring to FIG. 2, the rectangular base 1 is seen to be bounded by folding lines. On the east and west side of the base 1 are inner side flaps 2 and outer side flaps 3. At either end of the inner side flap 2 is a square 4 divided by a diagonal folding line. Next, adjacent to the square 4 is a right-angle triangle 5 having its right angle pointing inwardly.

At the south end of the base is a rectangular first south flap 6 and a trapezoidal second south flap 7. Finally, a rectangular tuck flap 8 completes the south end of the cut-out.

North of the base 1, a first north flap 9 similar to the first south flap 6 is joined to the base along a folding line. Next, a second north flap 10 is joined to the flap 9 by along a folding line. A rectangular third north flap 11 is next joined to the second north flap 10. An incline flap 12 is joined to the third north flap by folding line having perforations 13 along the length of the folding line. At the east and west sides of the incline flap are incline side flaps 14 of triangular dimension. At the north end of the cut-out is a rectangular incline support flap 15. Each of the flaps is joined to adjacent flaps by folding lines. Double parallel folding lines spaced apart by a short distance sufficient to overlay the double thickness of adjacent folded flaps are provided between the first south flap and the second south flap and the tuck flap and between the first north flap and the second north flap.

Figure 3:
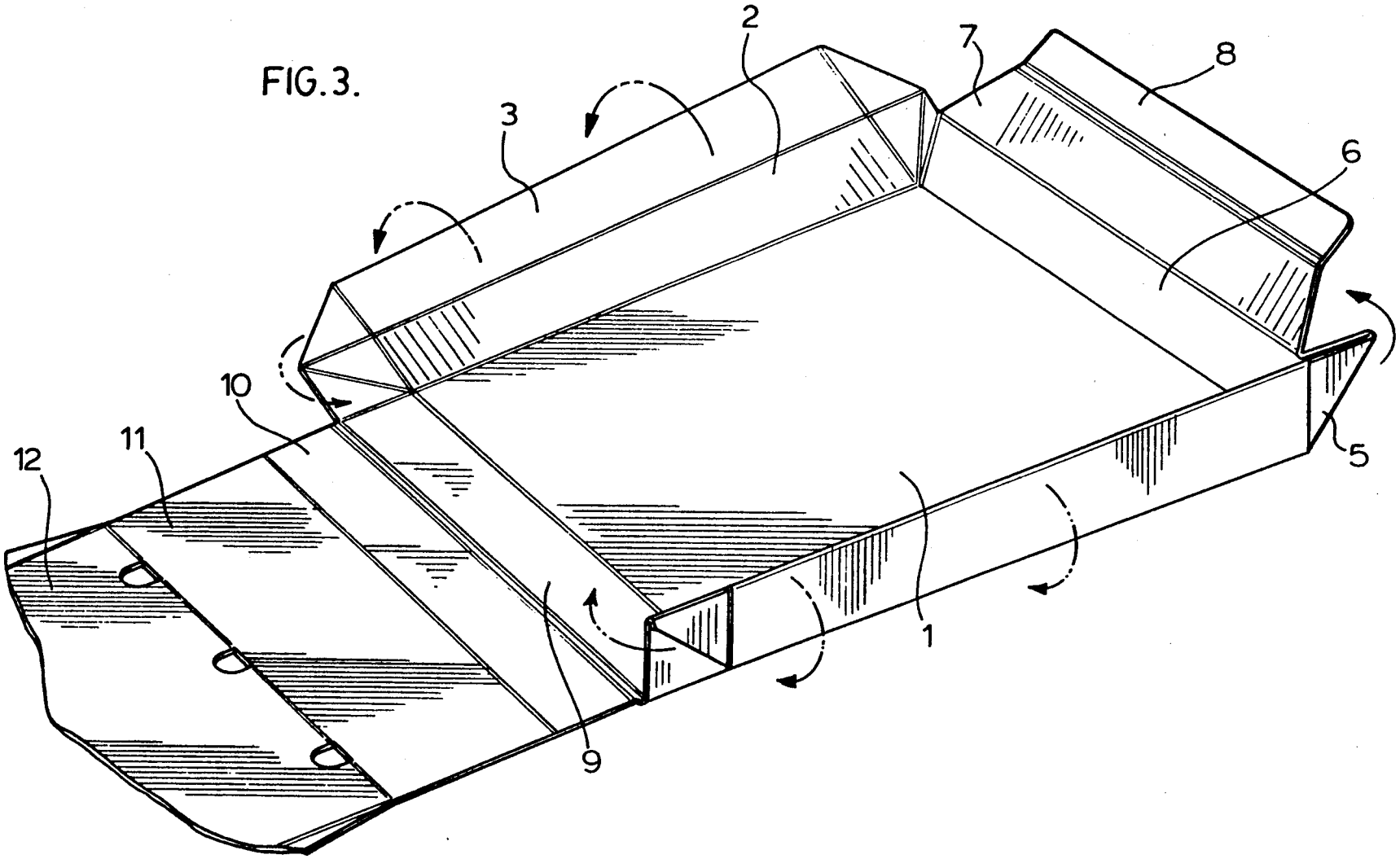
FIG. 3 illustrates the first folding of the side flaps and end flaps.
Figure 5:
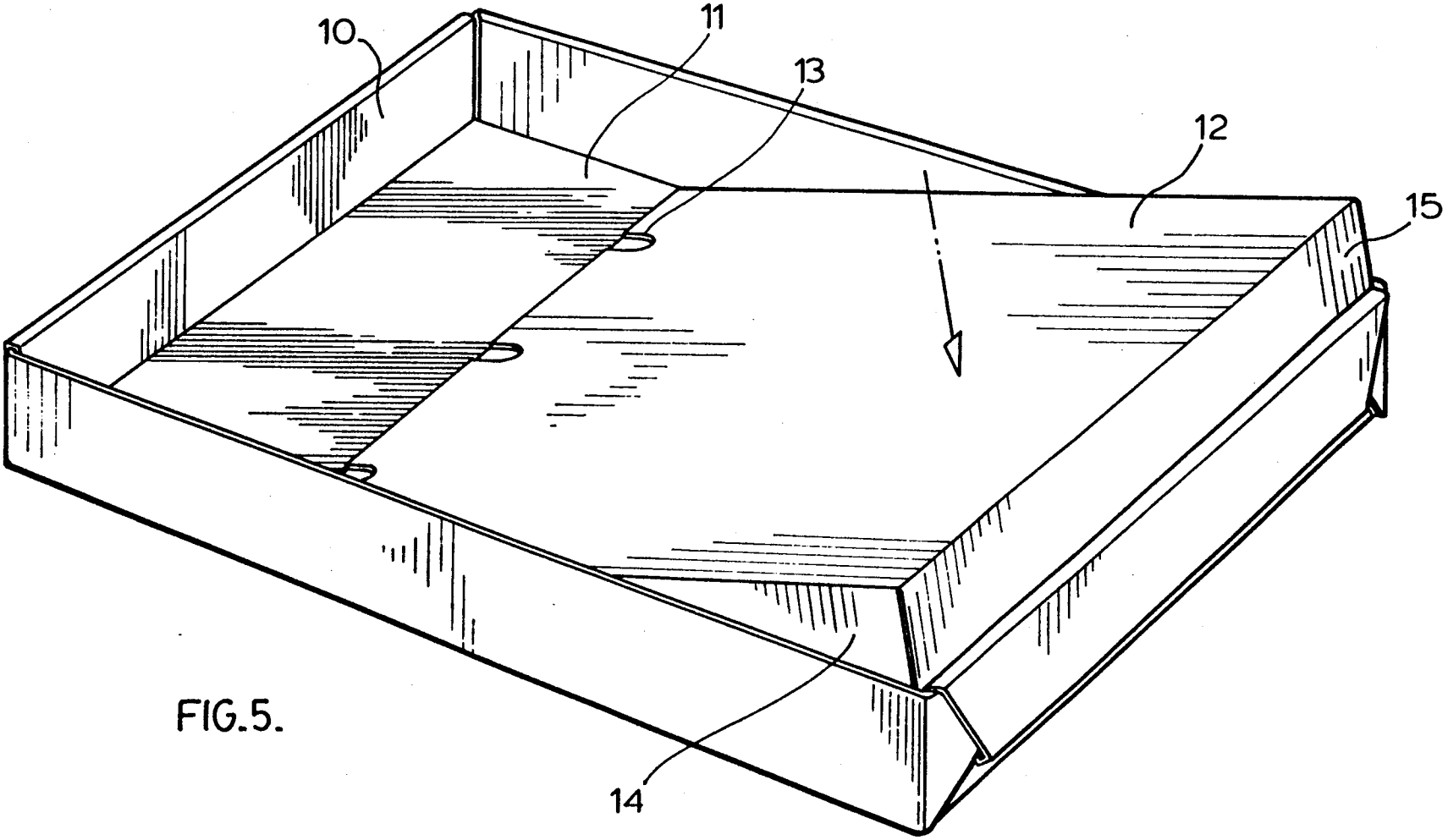
FIG. 5 illustrates how the incline is fitted within the paint tray.

As illustrated in FIG. 3, the inner side flaps 2 and the first south flap 6 may be folded upwardly. Then the outer side flaps 3 may be folded outwardly and downwardly over the inner side flaps 2. The square 4 may be folded outwardly along its diagonal line to form a triangle which may be then folded inwardly behind the first south flap 6 to provide structural support. Next, the second south flap 7 may be folded over the inwardly bent triangles and the tuck flap 8 may be inserted beneath them as best illustrated in FIG. 5 to complete the south end of the tray.

Figure 4:
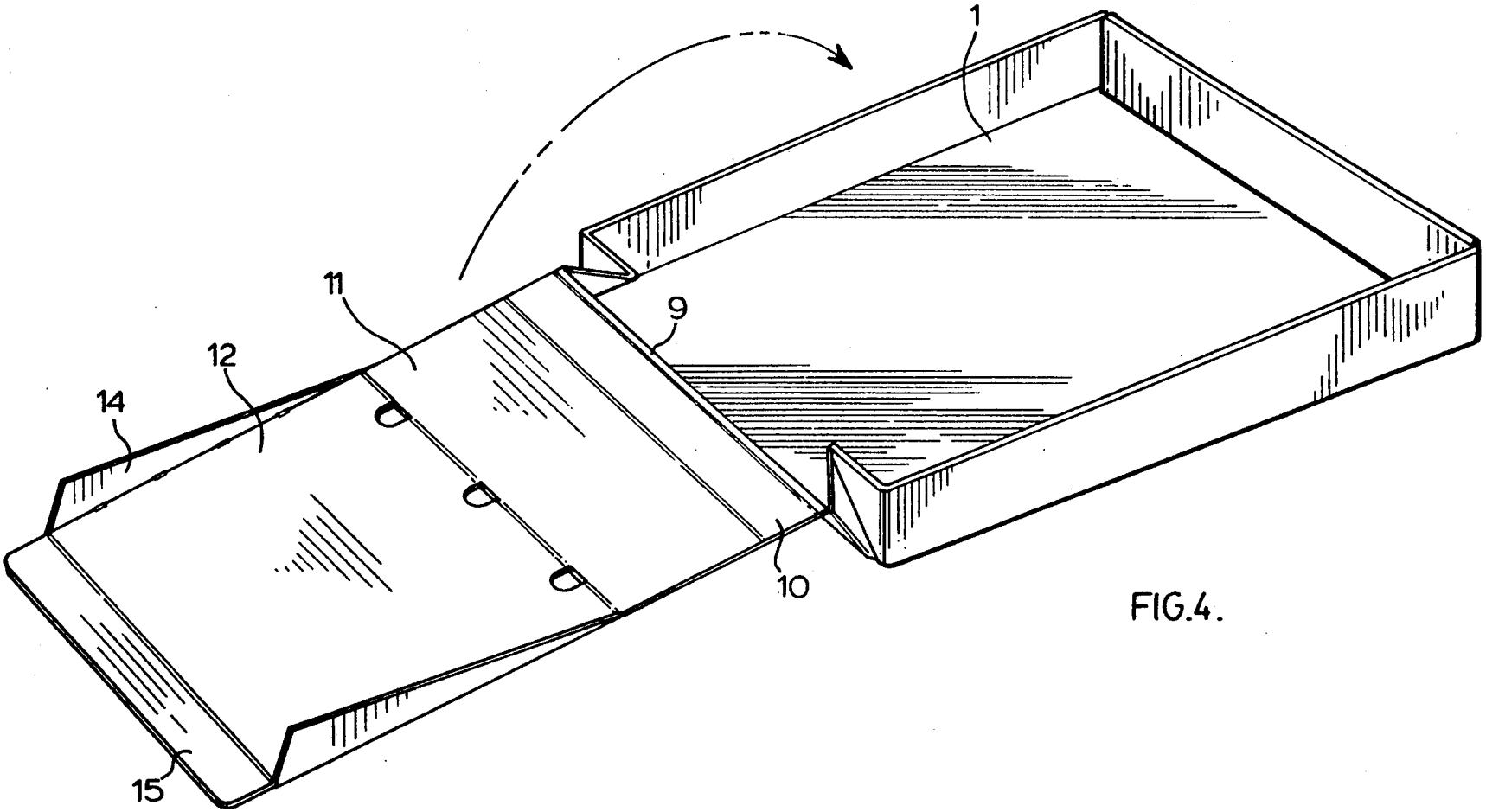
FIG. 4 illustrates the folding of the incline flaps.

As illustrated in FIG. 4, the squares at the north end of the base may be folded inwardly along the diagonal folding lines while folding the first north flap 9 upwardly to form a wall of the tray. Next, the second north flap 10 may be folded over the top edge of the first north flap 9 so that third north flap 11 lies over the base 1. The incline side flaps 14 and the incline support flap 15 may be bent downwardly within the walls of the tray to support the incline flap 12 at an angle. The insertion of the incline flap into the tray is best illustrated in FIG. 5. The perforations 13 permit paint to flow under the incline flap and to flow back out to replenish the paint lying over the base flap 11.

Figure 1:
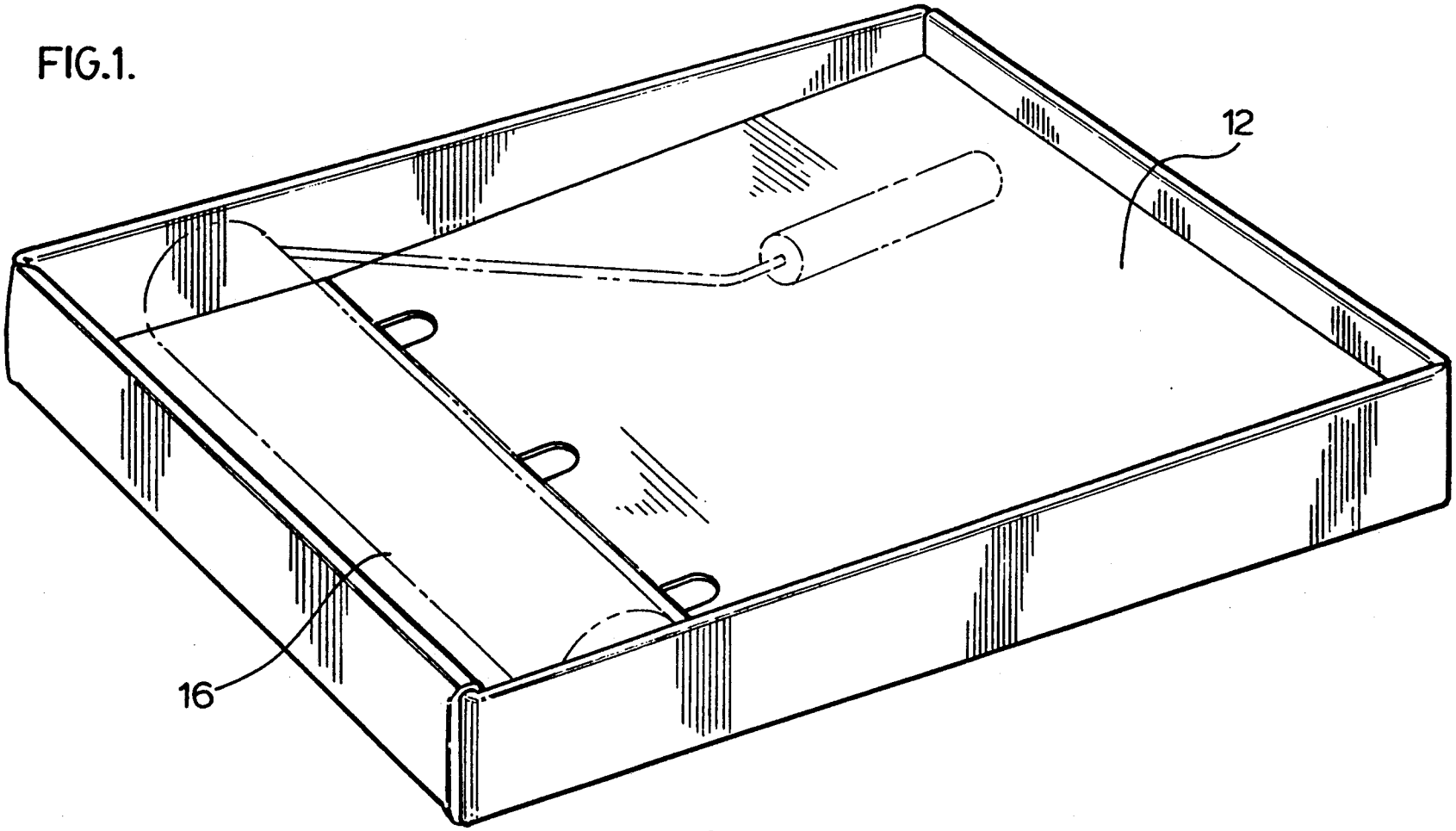
FIG. 1 illustrates the completed paint tray of this invention.

In operation, a painter would fold up the cut-out as described to make a paint tray. Then the paint tray would be filled with paint over base flap 11. The paint would flow through the perforations 13 under the incline flap 12. The painter would apply his paint roller 16 to the incline flap 12, roll it into the well portion to wet it as illustrated in FIG. 1. The paint roller 16 would then be rolled back and forth along the incline flap 12 to wet all the surfaces of the roller evenly. Then the roller would be used to paint a wall.

The embodiments of this invention in which an exclusive property and privilege are claimed are:

1. A cut-out to be folded into a paint tray comprising:

a rectangular base having an east and a west long side and a north and a south short side and four corners, each side being bounded by folding lines, an east and a west rectangular inner side flap, each having east and west long sides and north a south short sides, the east long side of the west inner side flap being attached along a folding line to the west long side of the base, the west long side of the east inner side flap being attached along a folding line to the east long side of the base said inner said flap being otherwise bounded by folding lines, an east and a west rectangular outer side flap, each having east and west long sides and north and south short sides, the east long side of the west outer side flap being attached along a folding line to the west long side of the inner side flap, the west long side of the east outer side flap being attached along a folding line to the east long side of the inner side flap and being otherwise bounded by two folding lines and a side edge of the cut-out, four squares having four sides, each of said four squares being attached to a different one of the short sides of the inner side flaps along a folding line and each of said four squares being bisected by a folding line proceeding from the intersection of the folding lines at the corner of the base adjacent to the square to a diagonally opposite corner of the square, four triangular flaps, each having one side attached along a folding line to a different one of the short sides of the outer side flaps and having another side attached along a folding line to a side of an adjacent square, a rectangular first south flap bounded by folding lines and having a long side attached to the south short side of the base and having short sides attached on the east and west to an adjacent side of a square, a second south flap shaped as a trapezoid having a long side attached to the first south flap by a folding line and otherwise bounded by east and west cut-out edges which slant inwardly and a folding line, a rectangular tuck flap having a long side attached to the second south flap by a folding line and otherwise bounded by three cut-out edges, a rectangular first north flap having a long side attached along a folding line to the north short side of the base and having east and west short sides attached along folding lines to an adjacent square, a rectangular second north flap having a long side attached along a folding line to the first north flap and having east and west short sides being cut-out edges, a rectangular third north flap having a long side attached by a folding line to the second north flap and having east and west short sides being cut-out edges, a rectangular incline flap bounded by folding lines having a short side attached along a folding line to the third north flap said folding line having perforations spaced along its length;

two incline side flap of triangular shape each having a long side attached along a folding line to a different one of the east and west sides of the incline flap; and a rectangular incline support flap having a long side attached along a folding line to the end of the incline flap and having three other sides being cut-out edges.

2. The cut-out of claim 1 in which double parallel folding lines spaced apart by a short distance sufficient to overlay the double thickness of adjacent folding flaps are provided between the first south flap and the second south flap and the tuck flap and between the first north flap and the second north flap.

* * * * *